US005363348A

United States Patent [19]

Damle

[11] Patent Number: 5,363,348

[45] Date of Patent: Nov. 8, 1994

[54] HIGH RESOLUTION, REMOTELY RESETTABLE TIME CLOCK

[76] Inventor: Madhav N. Damle, 100-25 Queens Blvd., Apt. 4N, Forest Hills, N.Y. 11375

[21] Appl. No.: 940,550

[22] Filed: Sep. 4, 1992

[51] Int. Cl.[5] ..... G04C 11/02

[52] U.S. Cl. ..... 368/47

[58] Field of Search ..... 368/10, 46, 47, 59, 368/60; 455/181, 231

[56] References Cited

U.S. PATENT DOCUMENTS

| | | | |
|---|---|---|---|
| 3,213,602 | 10/1965 | Pfeffer et al. . | |
| 3,490,225 | 1/1970 | Duris et al. . | |
| 3,643,420 | 2/1972 | Haydon . | |
| 3,732,685 | 5/1973 | Haydon . | |
| 3,739,568 | 6/1973 | Van Haaften . | |
| 4,204,167 | 5/1980 | Liu . | |
| 4,315,332 | 2/1982 | Sakami et al. | 455/181 |
| 4,420,263 | 12/1983 | Besson et al. . | |
| 4,501,502 | 2/1985 | Van Orsdel . | |
| 4,565,454 | 1/1986 | Walters | 368/47 |
| 4,645,357 | 2/1987 | Allgaier et al. . | |
| 4,650,344 | 3/1987 | Allgaier et al. . | |
| 4,823,328 | 4/1989 | Conklin et al. . | |
| 4,860,268 | 8/1989 | Allgaier et al. . | |
| 5,231,612 | 7/1993 | Allgaier et al. | 368/47 |

*Primary Examiner*—Vit W. Miska
*Attorney, Agent, or Firm*—Schweitzer, Cornman & Gross

[57] ABSTRACT

A low cost, remotely resettable wall clock or the like is provided, which is driven by a conventional quartz crystal oscillator system, for example. On a once a day basis, a reset signal is received from a local broadcast station, which serves to reset the clock to a predetermined reset time, typically 02:00:00 am. The system includes means for automatic startup of the clock without setting of the hands, eliminating the need for mechanical reset facilities. The control system includes means for automatically advancing or retarding the clock reset by one hour, to accommodate the beginning or the end of day light saving time. The economical design of the clock system enables it to be suitable for household as well as commercial use.

13 Claims, 10 Drawing Sheets

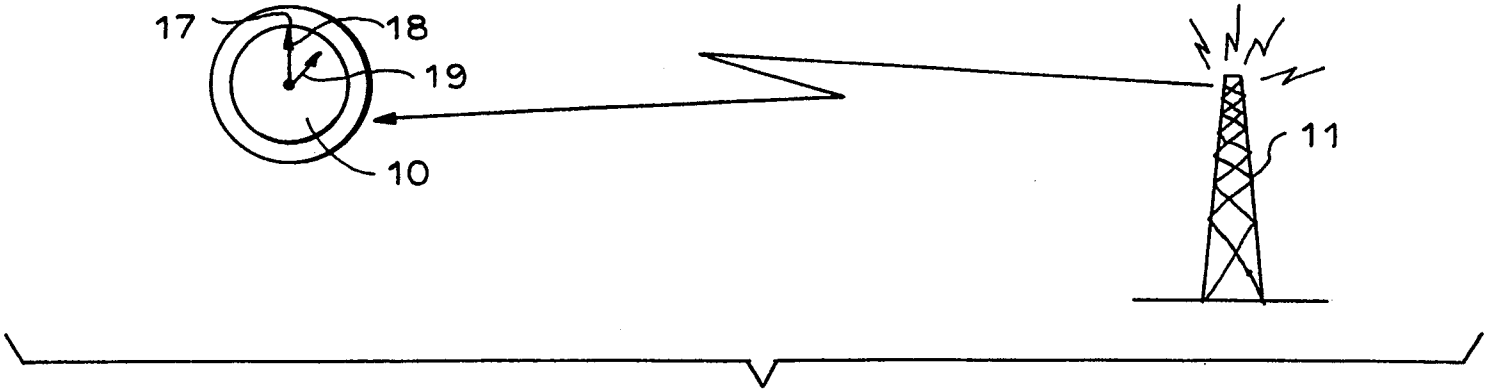
FIG. 1
FIG. 11
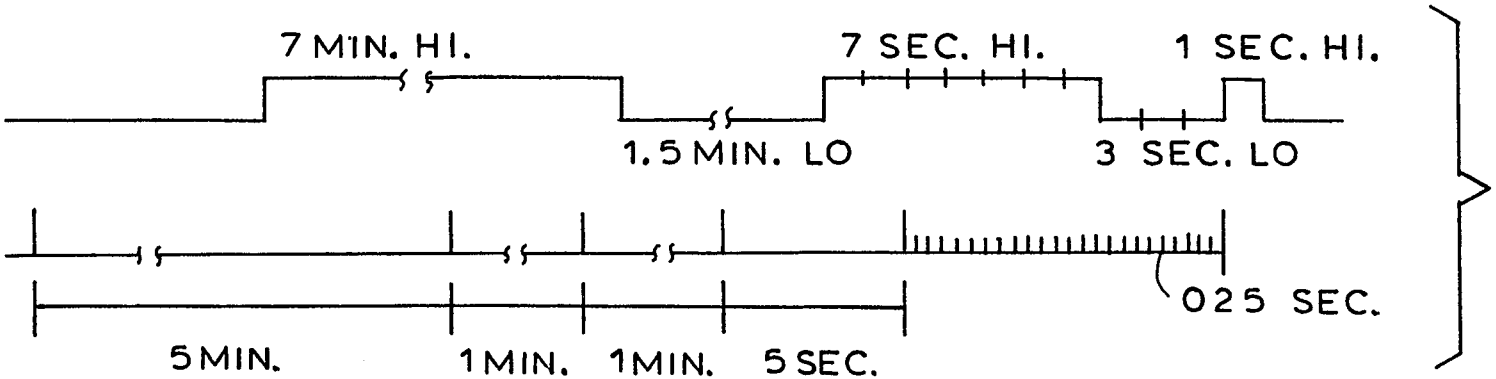

C
NORMAL RESET SIGNAL
50
NO
RESET COUNTER
RESET CLOCK @ 1 PULSE/SEC.
51
B
52
BACK ONE HOUR
NO
53
HOLD 3600 PULSES
RESET COUNTER AND CLOCK @ 1 PULSE / SEC.
B
53
FORWARD ONE HOUR
NO
ERROR
54
RESTART COUNTER AND CLOCK DRIVE @ 2 PULSES SEC. FOR 7200 PULSES
RESUME 1 PULSES/SEC.
B

HIGH RESOLUTION, REMOTELY RESETTABLE TIME CLOCK

BACKGROUND AND SUMMARY OF THE INVENTION

Wall clocks and the like are available commercially which provide for remote resetting or remote synchronization, in order that the time displayed at a particular location will be accurately synchronized with time signal information broadcast from a central control point. A number of systems utilized for this purpose involve the reception and processing of time signal information which is constantly broadcast from government operated radio stations, such as WWVA and WWVB. Clock systems of this type, while highly accurate, are complex, usually quite expensive, and generally not suitable for household use.

A more economical form of resettable clock system involves the use of mechanical clutches or the like allowing the hands of the clock to be reset to a desired reference time in response to an external signal. These systems, while more economical than the systems described above, are somewhat lacking in accuracy, due to the involvement of mechanical clutch devices, and are nevertheless sufficiently costly as to limit their utilization principally to industrial and commercial activities.

In accordance with the present invention, a novel and improved clock systems is provided, which enables a highly accurate wall clock or the like to be provided and controlled at extremely low cost, sufficiently low to be suitable and attractive for general household usage, as well as commercial and industrial usage.

The clock system of the invention employs a unique and highly simplified control system for driving and controlling the hands or other timekeeping elements of the clock and accommodating resetting of the timekeeping elements to a precisely controlled reference time on a once-a-day basis.

The system of the invention advantageously employs a quartz crystal driven pulse generator, which can operate from conventional dry cell batteries and which is arranged to deliver a pulse output corresponding to one pulse per second. The output pulses serve to drive the three hands of the clock, which are geared together for movement in fixed ratios corresponding to seconds, minutes and hours. A simple stepper motor or the like may be used to advantage for driving the gear system for the clock hands. A series of cascaded counters are provided for maintaining a precise count of the output pulses. Resetting of the clock is performed on a daily basis, in response to a accurately timed signal received from a local radio station. The procedures followed for effecting the daily resetting are simple, and may be accomplished with inexpensive components, yet provide for exceptionally reliable and accurate time keeping.

Pursuant to one advantageous form of the invention, a timing signal is received at a precisely controlled time each day, preferably exactly at 02:00:00 am, when any resetting of the clock may be accomplished with minimum inconvenience. A few moments before the 02 am reset time, for example, at 01:59:50 am as indicated by the clock's internal counting system, the rate of pulses delivered to the clock drive is increased, preferably to two pulses per second. Accordingly, the clock hands reach the exact 02:00 am position approximately five seconds ahead of the time indicated by the clock's counter system. When the clock hands are in the exact 02:00 am position, further pulse input to the clock driving system is automatically interrupted and the clock hands remain fixed. At the exact moment of 02:00 am, as determined by a precision master clock at the central broadcasting station, a time signal is broadcast and is detected by the remote clock system. This time signal immediately resumes the flow of actuating pulses to the clock drive system and, at the same time, resets the clock counter to zero.

Although advancing the clock hands five seconds prior to the 02:00 am reset time is typically more than adequate to accommodate any variation in a quartz driven time keeping system (normal accuracy within one or two seconds per day), there may be circumstances in which the reset signal is not received from the broadcast station within a reasonable time window, e.g., ten seconds. In such cases, the clock system is restarted without adjustment, except to restore the few seconds during which the clock drive was held motionless as a result of interruption of pulses to the drive system. Additional provisions are made so that, if a number of successive days pass without the proper reception of a reset signal, the clock will be stopped at the 02:00 A.M. reset position and not restarted, as an indication to the user of a malfunction in the reset system.

In another advantageous form of the invention, the receipt of the reset signal (provided it is detected within a brief, ten second window provided) triggers a system which temporarily stores the reading of the "seconds" counter, in a range from zero to nine (four line BCD output), at the moment of the instant of the reset signal. A "seconds" counter reading in the range of one to four, indicates that the clock is one to four seconds fast, and a corresponding number of pulses is subtracted from the regular flow of such pulses, so that both the counter and the timekeeping mechanism are resynchronized with the time reference provided by the reset signal. If the counter value at the moment of the reset signal is in the range of six to nine, that indicates that the clock is four to one seconds slow, and an appropriate number of extra pulses is added to the pulse stream to synchronize the clock with the reference signal.

In any of its various forms, the clock system of the invention includes a start-up feature which functions during the initial start-up of the clock, after battery changes, or when a malfunction in the broadcast-/receiving system prevents the clock from detecting the reference signal for a predetermined number of days (typically ten days). The start-up condition of the clock is indicated by a "flag" address in the logic chip controller which initially reflects an "unset" condition of the clock. When the clock is powered up and started for the first time, the unset flag causes the pulse-actuated clock drive to receive pulses at a greatly increased rate relative to normal, for example, ten pulses per second. The clock is thus driven in a relatively short period of time to the position in which it can expect to receive a reset signal, for example, 02:00:00 am. The clock hands automatically are stopped in that position by the interruption of the pulse stream and the system awaits the arrival of the next reset signal. When the signal is received, the clock commences normal operations, and the start-up flag is set to indicate normal operations.

To particular advantage, the system of the invention provides for automatic adjustment of the clock to accommodate the beginning and ending of daylight saving time. On the respective days for the beginning and ending of daylight saving time, the time keeping signal sent by the broadcasting station is of a distinctive character recognizable by the tuned receiver of the clock system and which operates to add or subtract exactly one hour from the pulse train to the clock driving system.

It is contemplated that the clock system of the invention will be driven by a quartz crystal oscillator type pulse generating system. Such systems are widely used and very inexpensive, and have a level of accuracy reliably within one or two seconds per day. Accordingly, by providing for daily reset of the clock, it is assured that timekeeping accuracy will be extremely high by normal household and commercial standards, suitable for all but the most demanding applications. At the same time, the system can be made available at a cost only modestly above that of conventional. household clocks provided with manual reset features. Among other things, the clock of the invention eliminates all manual reset facility, so that the additional cost of the electronic control system is offset in significant part by the elimination of mechanical parts otherwise required.

The system of the invention may take a variety of specific forms each, however, being characterized by a high level of simplicity and economy, so that a simple, low cost, battery driven clock may be provided with an accurate daily reset feature, automatic start up, and automatic adjustment for daylight saving time.

For a more complete understanding of the above and other features and advantages of the invention, reference should be made to the following detailed description of several preferred embodiments of the invention, and to the accompanying drawings.

DESCRIPTION OF THE DRAWINGS

FIG. 1 is a simplified, schematic representation of a clock system according to the invention.

FIG. 11 is a simplified time diagram illustrating a representative form of timed reset signal from a remote broadcasting station, and the manner of detecting the same within the clock system of the invention.

DESCRIPTION OF PREFERRED EMBODIMENTS

Figure 2:
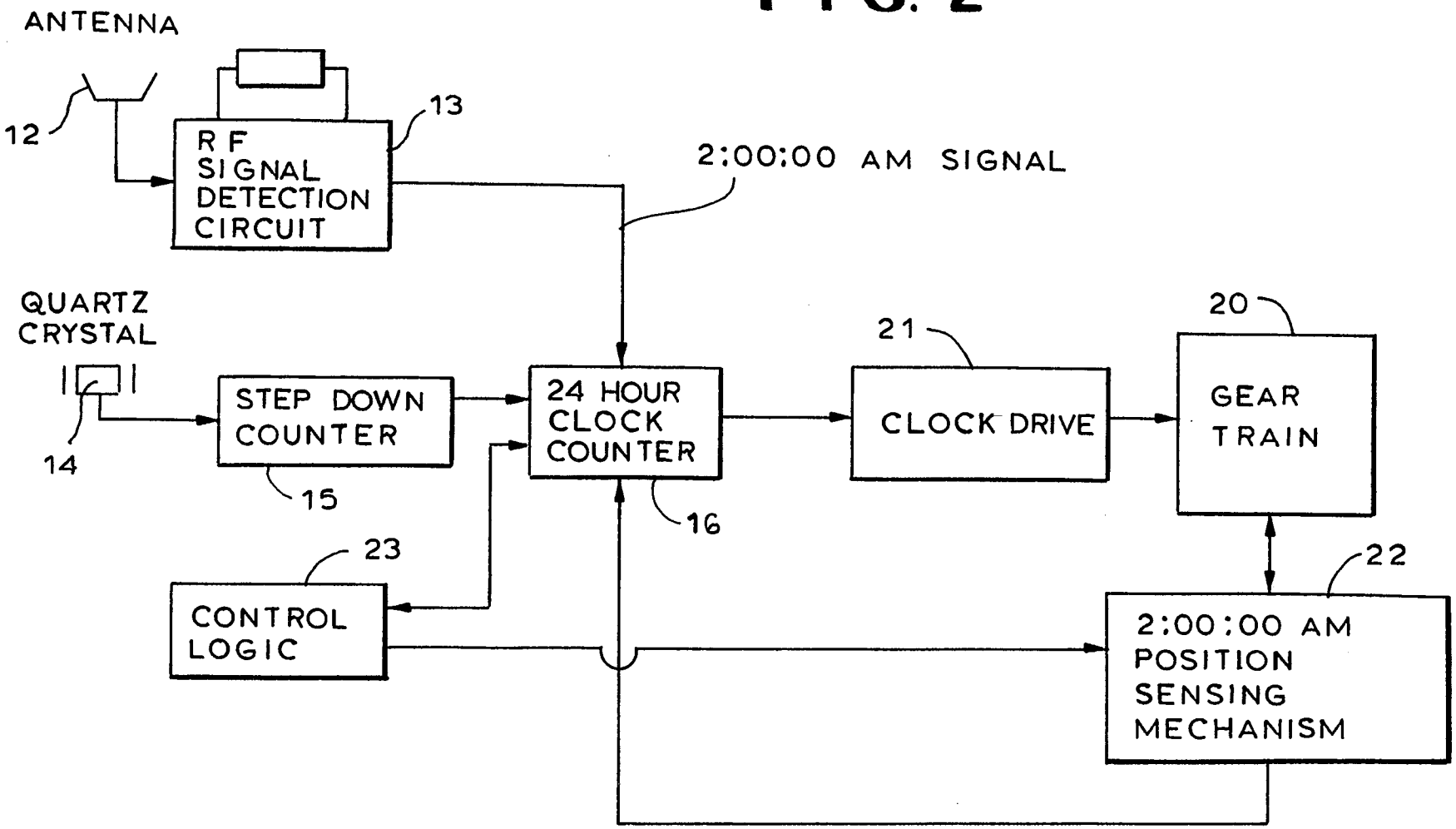
FIG. 2 is a simplified block diagram of a clock mechanism incorporating control features according to the invention.

Referring now to the drawing, the clock system of the invention incorporates a specially configured clock 10, typically but not necessarily a wall clock, which includes provisions to receive a daily reset signal from a remote source, advantageously a commercial FM or AM radio station which is itself equipped with a highly accurate master clock system controlled by, for example the U.S. government station WWVB. The clock 10 is illustrated schematically in FIG. 2 and is shown to include a built-in antenna 12 connected with a tunable receiver 13 tuned to the frequency of the daily reset signal from the radio source 11. Where the reset signal is broadcast from an active commercial AM or FM station, for example, the frequency can be set at a level out of the range of normal hearing (preferably subsonic) so as to be inaudible to the radio listener.

The clock 10 is driven by a quartz crystal oscillator system 14, which is connected through a step-down counter 15 to a 24-hour clock counter 16. In a preferred form of the invention, the step-down counter is designed to provided selectively usable output pulses at rates of ten per second, two per second, and one per second. The clock counter comprises a cascaded series of counters including a counter for seconds, tens of seconds, hours and tens of hours. Such counters are per se well known. In general, quartz crystal driven clock systems are widely used because of their relative low cost and relatively high accuracy. Such clocks are usually reliably accurate within one or two seconds per day.

In its most advantageous form, the clock of the invention is an analog clock provided with a second hand 17, minute hand 18 and hour hand 19. These are connected through a gear train mechanism 20 which is in turn driven by a clock drive 21, which may be a step motor or the like connected directly to the gear train. The drive means 21 is actuated by a pulse stream delivered from the step down counter 15. In the system of the invention, it is contemplated that control of the positioning of the clock hands 17, 19 will be derived exclusively from control of the pulse stream to the drive means 21. Accordingly, no clutch mechanism or other manual reset means is provided.

Pursuant to the invention, the clock is provided with a mechanism, generally indicated by the reference numeral 22 in FIG. 2, for sensing one unique daily position of the hands of the clock, preferably the 02:00:00 am position. Likewise, the system contemplates the arrival from the broadcast source 11 of a daily reset signal at exactly 02:00 am. These features, together with a control logic system to be described, enable the clock to be started up for the first time automatically on a synchronized basis with the daily reset signal, and then resynchronized on a daily basis with that signal. In the system of the present invention, these results, in themselves achievable with previously known systems, are accomplished with a system of extremely low cost, so as to be realistically available for household utilization, for example. Control of the clock system of the invention is provided by a simple preprogrammed low cost custom designed logic chip 23, which receives input from the position sensing mechanism 22, from the clock counter 16 and from the rf receiver 13.

For the initial start-up of the clock system of the invention, and in certain embodiments for the daily reset as well, provision is made for advancing the clock at an accelerated rate to the reset position which, for the purposes of this description, will always be the 02:00:00 am position. In one advantageous form of the invention, the 02:00:00 am position of the clock is sensed by a mechanism such as illustrated in FIG. 3, wherein the clock drive motor 21 is connected directly to a gear train 20 comprised of a series of nine gears 24–32 connected in series.

Figures 3, 4:
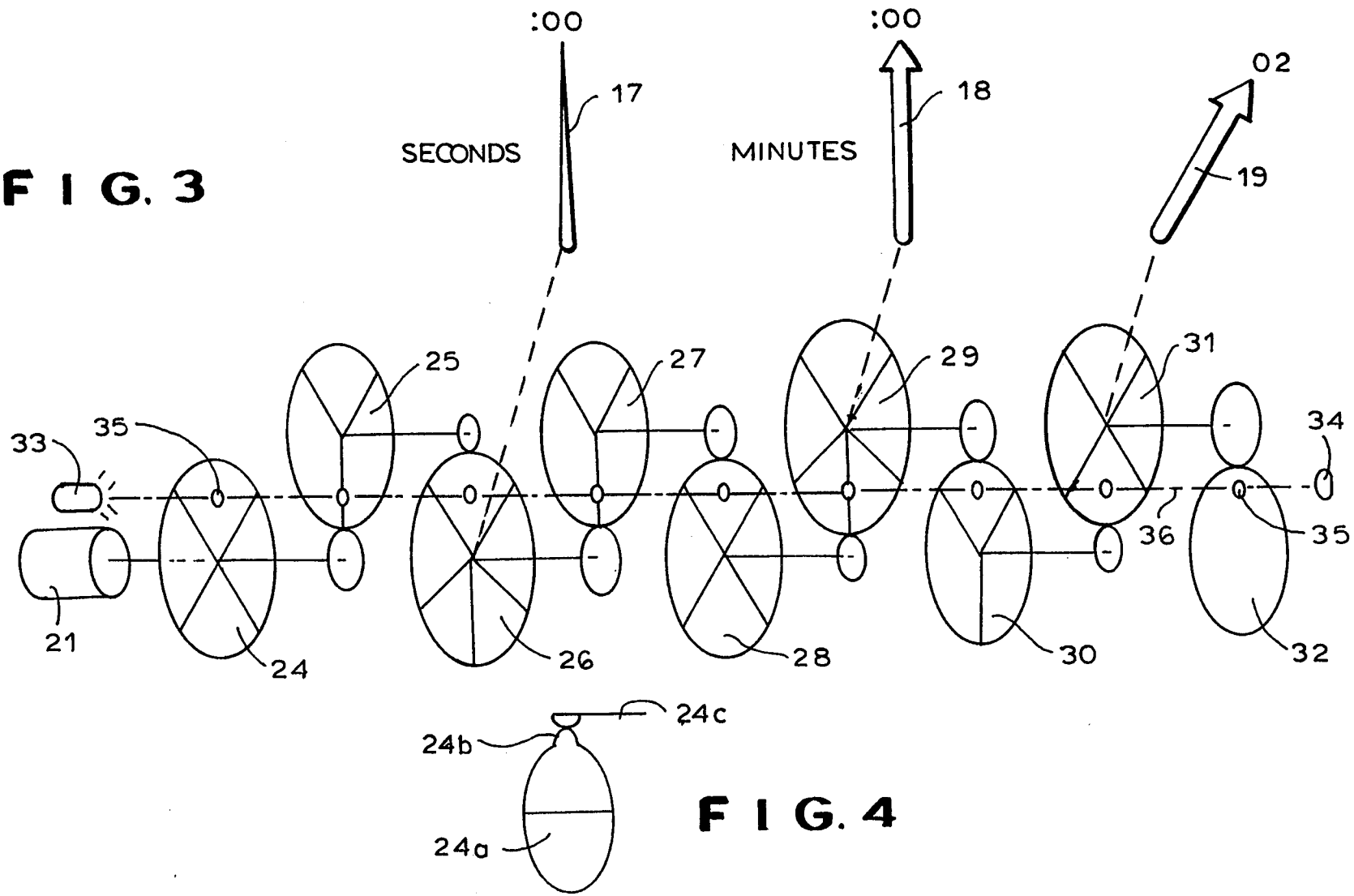
FIG. 3 is a schematic representation of a direct gear drive system advantageously employable in a clock system according to the invention.
FIG. 4 is an illustration of one representative modification of a control switch device employable in the clock system of the invention.

In the illustration of FIG. 3, it is assumed that the drive motor 21 rotates 90° in response to each electrical pulse received. The gear 24 is thus adapted to revolve once for each four actuating pulses received by the drive motor 21. The gear 25 is connected to gear 24 with a 3:1 reduction ratio and thus rotates once for each twelve pulses. The gear 26 is in turn connected to gear 25 through a 5:1 step down ratio and thus makes one revolution for each sixty pulses input to the motor 21. In the illustrated arrangement, the gear 26 is employed to drive the second hand 17. In normal operation, one pulse per second is delivered to the drive motor 21 and the second hand thus makes one revolution per minute. Gears 27, 28 and 29 respectively are connected via step down ratios of 3:1, 4:1 and 5:1 respectively, so that the gear 29 makes one revolution for each sixty revolutions of gear 26. Gear 29 is thus employed to drive the minute hand 18. Gears 30, 31 are connected to the gear 29 by way of reduction ratios of 3:1 and 4:1 respectively so that the gear 31 makes one revolution for each twelve revolutions of the gear 29. Gear 31 is thus employed to drive the hour hand 19. The final gear 32 is driven from the "hours" gear 31 with a 2:1 reduction ratio and thus makes one revolution for each twenty-four hours. In this respect, the preferred embodiments of the invention are designed as 12-hour clocks, and the final gear 32 enables the control to be carried out on a 24 hour basis.

In the illustration of FIG. 3, an optical system is employed for detecting the exact 02:00:00 am position of the clock. This is accomplished by providing a light source 33 at one end of the gear train and a photo sensor 34 at the other end. Each of the gears 24–32 is provided with an opening 35 which is arranged to intersect with the axis 36 extending between the light source 33 and photo sensor 34, at some point in the revolution of the gear. In the illustrated arrangement, where the gear system is advanced one increment per pulse, with the pulses arriving at the rate of one per second in normal operation, the gear system will have 86,400 unique positions per day. One of those positions, the exact 02:00:00 am position, is designed to take place when all of the openings 35 are aligned along the light axis 36. When such an alignment occurs, a circuit is completed by the photo sensor 34, initiating control actions to be described. It is to be understood, of course, that the specific form of position indicating system is representative only, as various different schemes may be employed. Among others, and by way of example only, the individual gears 24–32 may be arranged to actuate switches, one example of which is shown in FIG. 4, where a gear **24*a* is provided with a cam lobe 24*b* which actuates a switch 24*c*. If desired, the switch element 24*c* may contact with a conductive portion of the gear 24*a*, or the displacement of the switch 24*c*** may actuate switch contacts (not shown). As will be readily understood by those familiar with the art, a wide variety of sensing mechanisms may be employed for the purposes intended, and those illustrated are not to be regarded as limiting.

Figure 5:
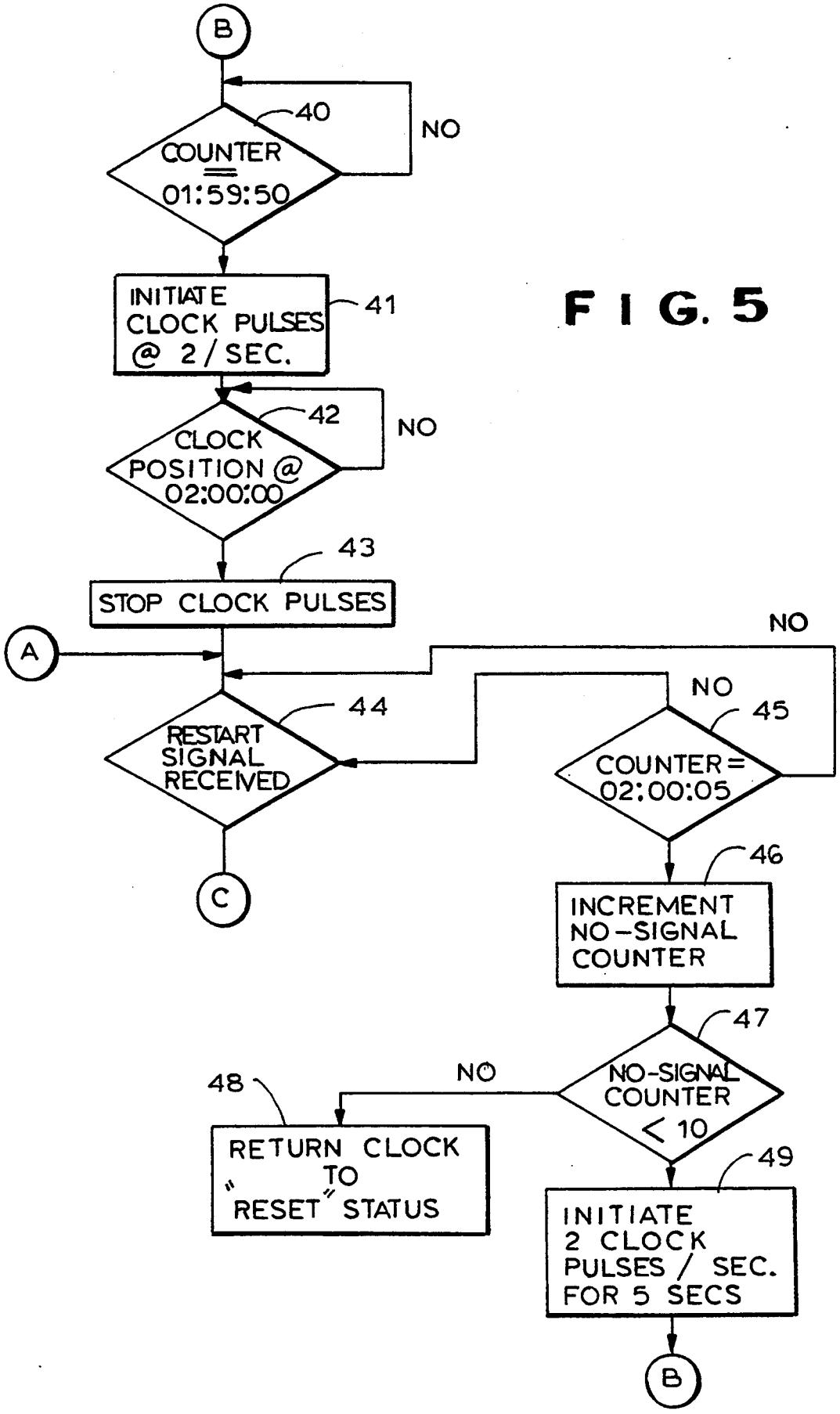
FIG. 5 is a logic flow diagram of a logic control for one advantageous form of clock system according to the invention.
Figure 6:
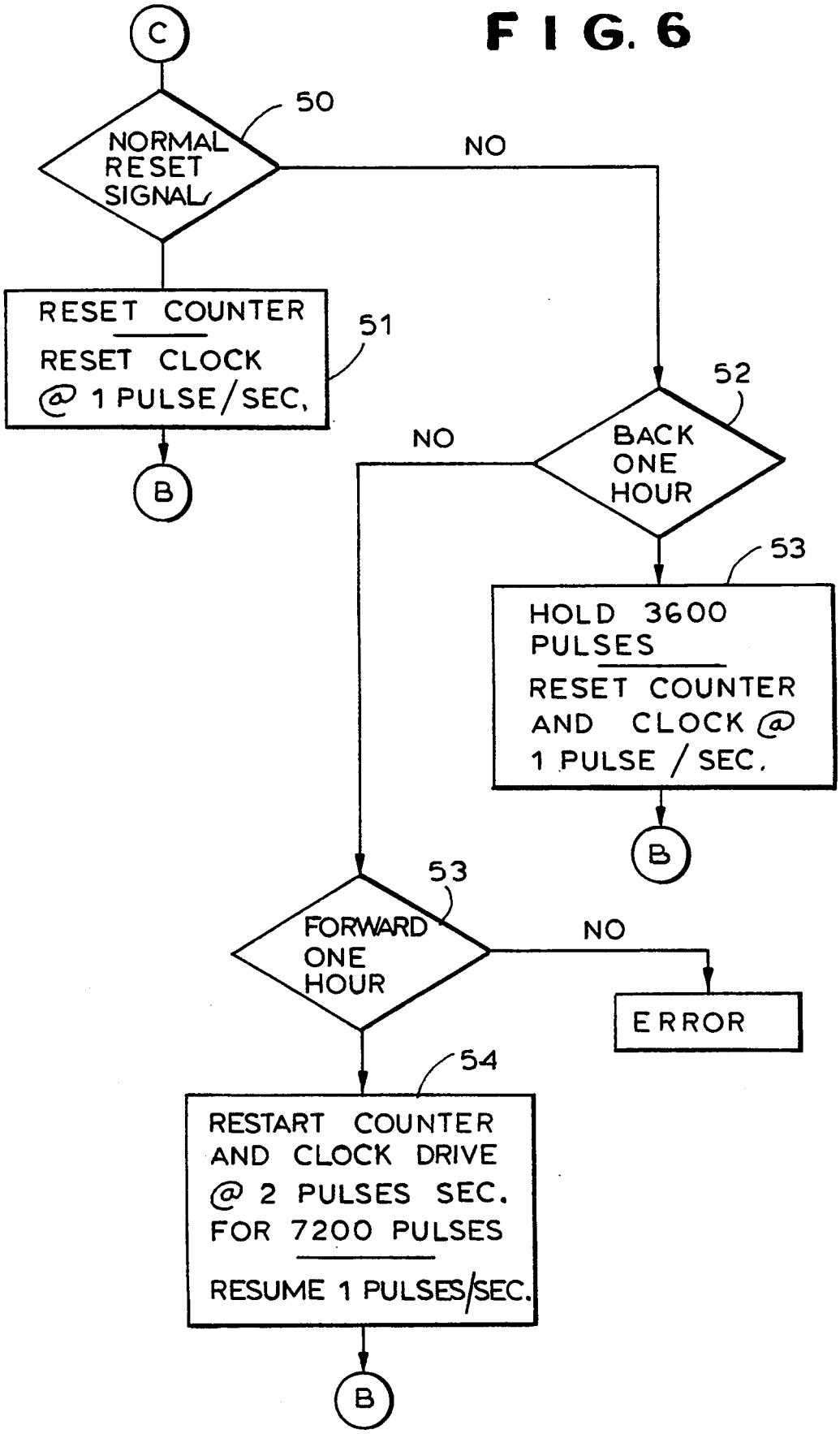
FIG. 6 is a further logic flow diagram for the clock system of FIG. 5.

In one advantageous modification of the invention, illustrated schematically in the logic diagrams of FIGS. 5 and 6, when the clock system is in its normal, running mode, the logic chip continuously checks the clock counter 16 to ascertain if the counter indicates a time of 01:59:50 am. This is indicated at logic point 40 of the FIG. 5 diagram. The indicated time is ten seconds prior to the expected receipt of a reset signal from the broadcast source 11. At that moment, the logic chip 23 causes the flow of pulses to the drive motor 21 to be increased from a normal rate of one pulse per second, to an accelerated rate of two pulses per second, reflected by the logic box 41 in FIG. 5. During this flow of pulses to the drive motor, the logic system is continually testing at logic point 42 for a signal indicating the arrival of the clock at the exact 02:00:00 am position, as determined by the sensing system represented in FIG. 3, for example. When the 02:00:00 am position is reached, control is passed to logic point 43 and the further flow of actuating pulses to the drive motor 21 is immediately interrupted, so that the clock remains fixed in the 02:00:00 am position pending receipt of the broadcast restart signal exactly at 02:00:00 am.

In this respect, it will be understood that, by reason of the two pulses per second rate of the pulse stream received by the drive motor, the clock will arrive at the exact 02:00:00 am position at 01:59:55, as determined by the clock's internal counter. Bearing in mind that the expected normal accuracy of the quartz crystal driven pulse generating system has an expected accuracy of one to two seconds per day, acceleration of the clock to reach the 02:00:00 am position, five seconds early by the clock's internal time keeping system, generally assures that the clock will be waiting at the precise 02:00:00 position when the restart signal is received.

The manner of detecting and processing the incoming restart signal from the broadcast station 11 will be described in more detail hereinafter. For the purposes of the logic flow diagram of FIG. 5, it is sufficient to indicate that the reset signal, when received, enters the point marked (A). The logic system, at the logic point 44, checks for the receipt of the restart signal. The moment the restart signal is received, the logic proceeds to point (C), in the diagram of FIG. 6.

During the repetitive testing for receipt of the restart signal at logic point 44, if the signal has not been received, the logic flow proceeds to logic point 45, which checks the status of the clock's internal counter. If the counter indicates an internal time earlier than 02:00:05, the control returns to logic point 44. Pursuant to the invention, however, if the restart signal has not been successfully received within a narrow time frame, preferably a ten second window between the clock's internal time of 01:59:50 and 02:00:05, the reset operation for that day is bypassed. Control in such a case proceeds to logic point 46, which increments a "no-signal" counter. Desirably, if the clock does not receive a reset signal for ten consecutive days, a major fault is indicated, and the clock is taken out of active service. This is accomplished at logic point 47, which tests the incremented value of the "no-signal" counter. If that value reaches ten, control is passed to logic point 48 and the clock is returned to an "unset" status, wherein the clock performs as if it were newly installed and/or the batteries were changed, features that will be described hereinafter.

If the "no-signal" counter is less than ten, control proceeds to logic point 49, pursuant to which the logic chip 23 initiates a flow of pulses to the drive motor 21 at the rate of two pulses per second for a period of five seconds. This serves to restore to the clock the five pulses lost during the period waiting for the reset signal to arrive, before the timeout, at 02:00:05. Under these circumstances, the clock is not reset to the 02:00:00 am reset reference, and any accumulated errors of the quartz crystal oscillating system will remain. Control then returns to point (B), at the top of FIG. 5 of the drawing, to ready the clock for the next day's reset signal.

In the modification illustrated in the logic diagrams of FIGS. 5 and 6, the detection of a normal restart signal at the 02:00:00 am restart time directs the control to logic point 50 in FIG. 6, where it is determined whether the reset signal is a "normal" signal or a special signal. In this respect, the clock system of the invention includes provisions for automatically accommodating the commencement and termination of daylight saving time, which requires setting of the clock one hour ahead or one hour behind, as the case may be. To this end, the broadcast station 11 is equipped to transmit distinctly different signals on the days of commencement and termination of daylight saving time. This may be accomplished by sending signals of greater or lesser time duration, by transmitting signals of special frequency, etc. The character of the signal is detected by the rf receiver 13, and the output of the receiver indicates the nature of the signal, i.e., whether it is "normal" or represents the commencement of daylight saving time or the termination thereof. At logic point 50, the signal is tested to determine if it is "normal". If it is, control proceeds to logic point 51, which causes the clock counter 16 to be reset to zero, and causes the flow of pulses to resume to the gear drive 21 at the rate of one pulse per second. Since the resumption of clock motion and resumption of counting has been reinitiated exactly at 02:00:00 am, any previous inaccuracies in the clock movement are eliminated, and the clock is restored to exact synchronism with the master clock at the broadcast station. After restarting of the clock at logic point 51, control returns to point (B), FIG. 5, where the system is readied for the next day's reset signal.

If the signal as detected at logic point 50 is not. "normal", it is again tested at logic point 52 to determine whether the clock is to be set back one hour, in which case the control proceeds to logic point 53. This results in the withholding from the pulse stream to the drive motor of exactly 3600 pulses.

If the test at logic point 52 determines that the signal is not for the end of daylight saving time, the control goes to logic point 53, where it is tested to confirm that the signal is for the commencement of daylight saving time (if not, an error condition is indicated). If the signal is, as expected, for the commencement of daylight saving time, control proceeds to logic point 54, which causes the clock counter to be reset to zero, and also causes the pulse stream to both the counter and the clock drive 21 to be increased at a rate and for a time to introduce an additional 3600 pulses to the clock and drive. Preferably, this is accomplished by increasing the pulse rate to two pulses per second, so that in one hour's time the clock and its counter will have advanced exactly one hour. When the additional pulses have been added, the pulse stream to the clock and counter are reduced to the normal one pulse per second rate for normal time keeping. Control then returns to the point (B), where the system is readied for the next day's reset signal, which will arrive twenty-three hours after the previous signal for that one day.

Figure 7:
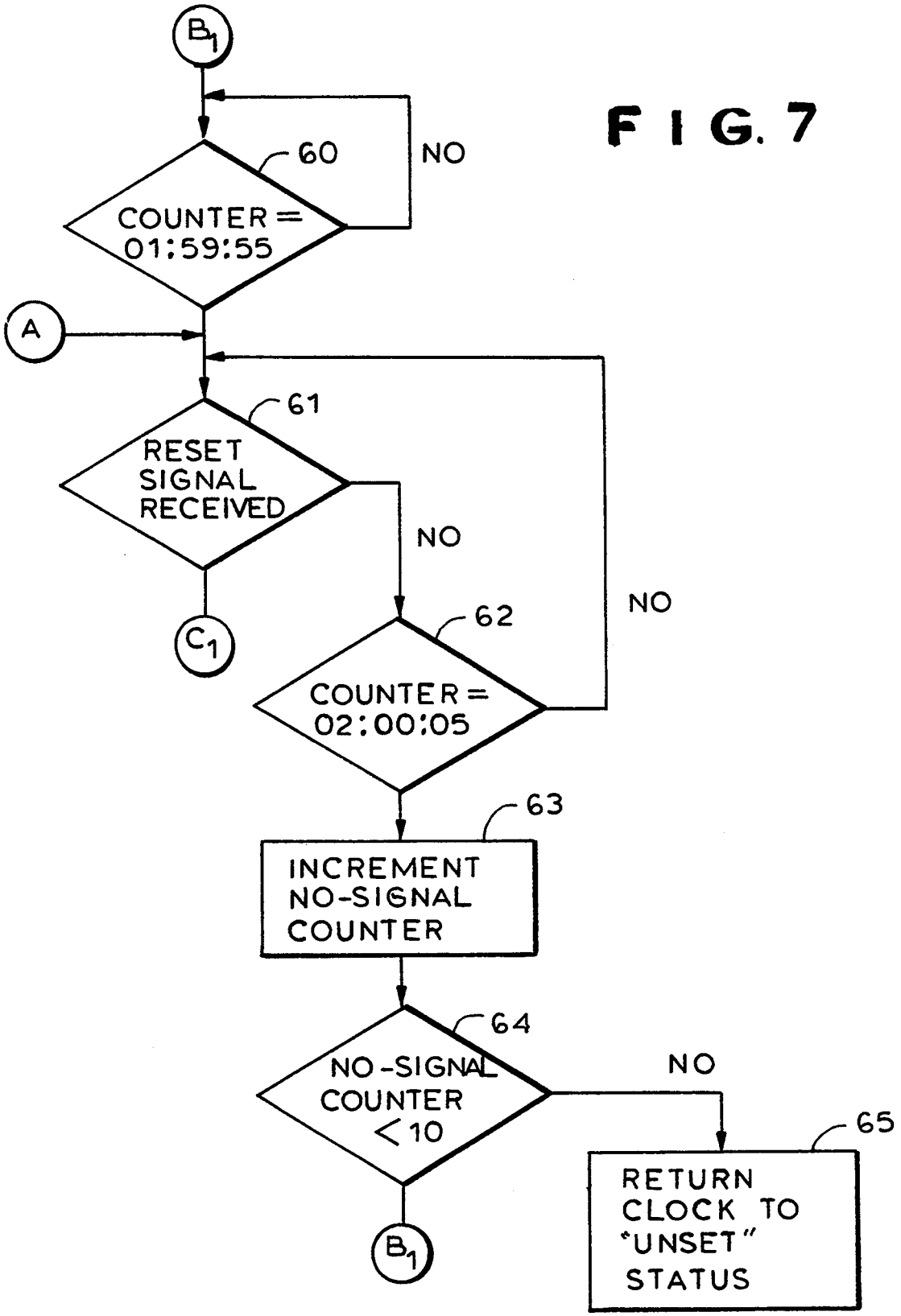
FIG. 7 is a logic flow diagram for a modified form of the clock system of the invention.
Figure 8:
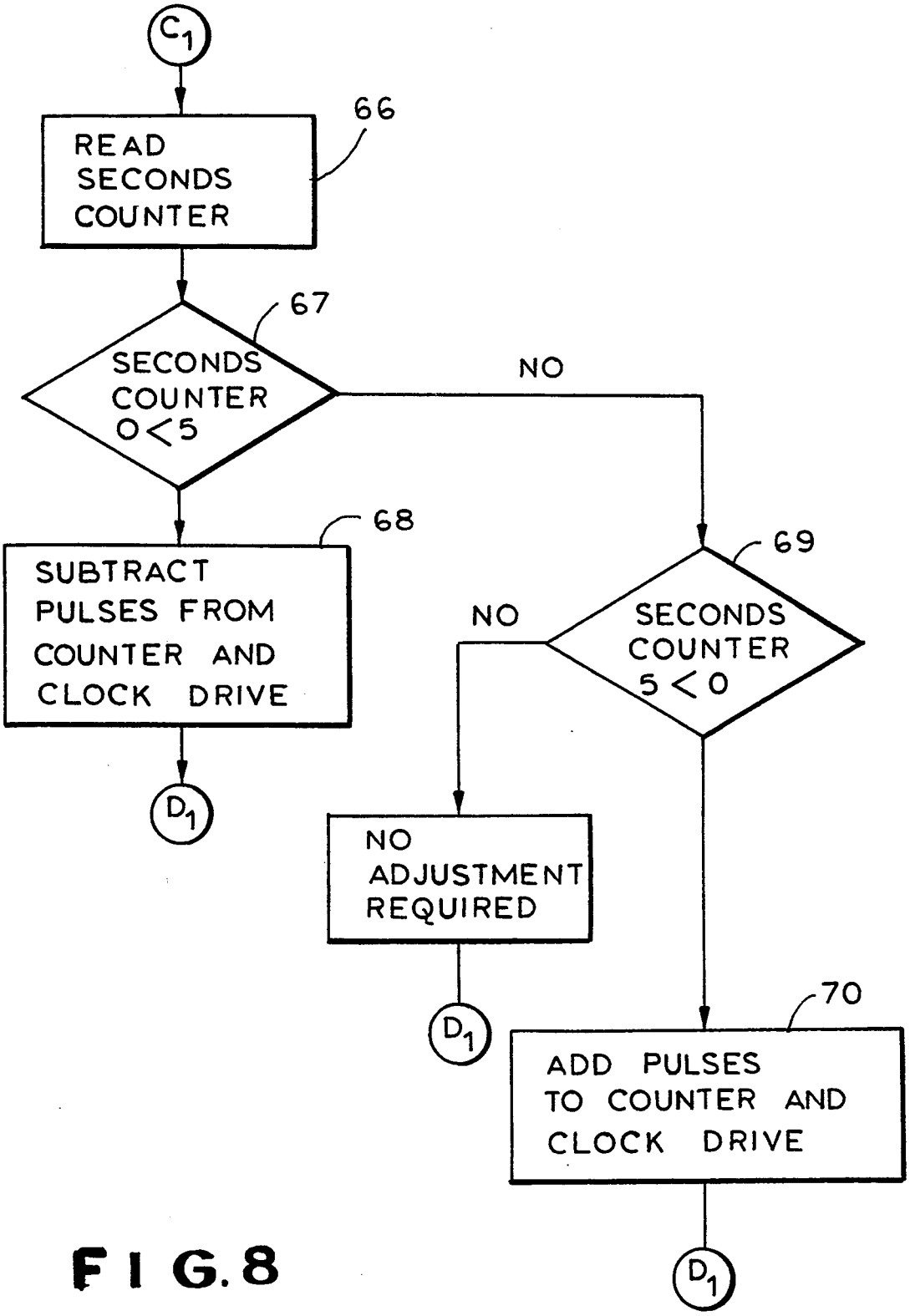
FIGS. 8 and 9 are further logic diagrams for the modification of FIG. 7.

In FIGS. 7 and 8, there are shown logic flow diagrams representative of a slightly different modification of the clock system of the invention in which, instead of advancing the clock hands ahead to the 02:00:00 am reset position and then restarting it upon receipt of the restart signal, the clock continues in its normal movements and the count value of the clock counter is determined at the instant of receiving the reset signal. If the reset signal is not received within a ten second window, commencing at 01:59:55 and ending at 02:00:05, the reset signal is ignored. Assuming that the signal is timely received, the value of the "seconds" counter necessarily will fall between zero and nine. If the value of the counter is in the range of from 1 to 4, it is indicated that the clock is 1 to 4 seconds fast, and an appropriate adjustment is made by withholding 1, 2, 3 or 4 pulses from the pulse stream, as may be required. If the "seconds" counter has a reading of from 6 to 9, it is indicated that the clock is slow in relation to the reset signal, and an appropriate number of seconds are added to the pulse stream in order to exactly synchronize the clock with the time reference provided by the reset signal.

With particular reference to FIGS. 7 and 8, the waiting condition of the clock is indicated at ($B_1$) at the top of FIG. 7. At logic point 60, the clock counter is continuously tested for a reading of 01:59:55 am. When this reading is achieved, control passes to logic point 61, where it is tested for receipt of the reset signal at the 02:00:00 am reset time, according to the master clock at the broadcast station. If the reset signal has been received, control passes to ($C_1$), for effecting the necessary adjustment to the reset signal reference.

As in the case of the embodiment of FIGS. 5 and 6, the system of the invention contemplates that the reset signal must be received within a ten second window. Accordingly, if the logic point 61 indicates that the reset signal has not been received, control passes to logic point 62, where the clock counter is checked for a reading of 02:00:05. If that reading has not yet been reached, control loops back to logic point 61 to continue testing for the presence of the reset signal, which comes in at point ($A_1$) in FIG. 7. If the ten second window expires without having received the reset signal, control passes to logic point 63, for incrementing of the no-signal counter. At logic point 64, the no-signal counter is tested for a value of less than ten. If such value is found, control is looped back to ($B_1$) at the top of FIG. 7. If, on the other hand, the no-signal counter has reached, for example, ten, representing a passage of ten consecutive instances of failure to receive the reset signal from the broadcast location, control is taken at logic point 65, which returns the clock to an "unset" status. This will cause the clock hands to return at high speed (driven at ten pulses per second) to the 02:00:00 reset position, and the clock will stop there until the reset signals resume or the fault is otherwise attended to.

Assuming that the reset signal is properly received, and is detected at logic point 61, control passes to logic point 66 (FIG. 8), which results in the sensing of the value of the seconds counter. Control then passes to logic point 67 where the counter value is tested as to whether it falls in the range of 1 to 4 seconds. If the counter value falls within that range, control proceeds to logic point 68, where the number of seconds on the seconds counter, as read in the instant of receiving the reset signal, is subtracted from the pulse stream delivered to both the clock counter 16 and the clock drive 21. Control then passes to ($D_1$) (FIG. 9) for treatment of possible signals representing the commencement or termination of daylight saving time, as will be further described.

If at logic point 67 it is determined that the seconds counter does not fall within the range of 1 to 4, control passes to logic point 69 for determination whether the seconds counter reading is in the range of 6 to 9. If it is not, no adjustment is required. If it does fall within that range, it is indicated that the clock is slow in relation to the reset reference, and an appropriate number of pulses must be added to the pulse stream to the clock counter 16 and the gear drive 21. For example, if the reading of the seconds counter at the instant of arrival of the reset signal is "six", it is indicated that the clock is four seconds slow, and four seconds must be added to the pulse stream for both the clock and gear drive, in order to bring the clock 10 into synchronism with the reset signal reference. This adjustment is performed at logic point 70, after which control is transferred to ($D_1$) (FIG. 9).

Figure 9:
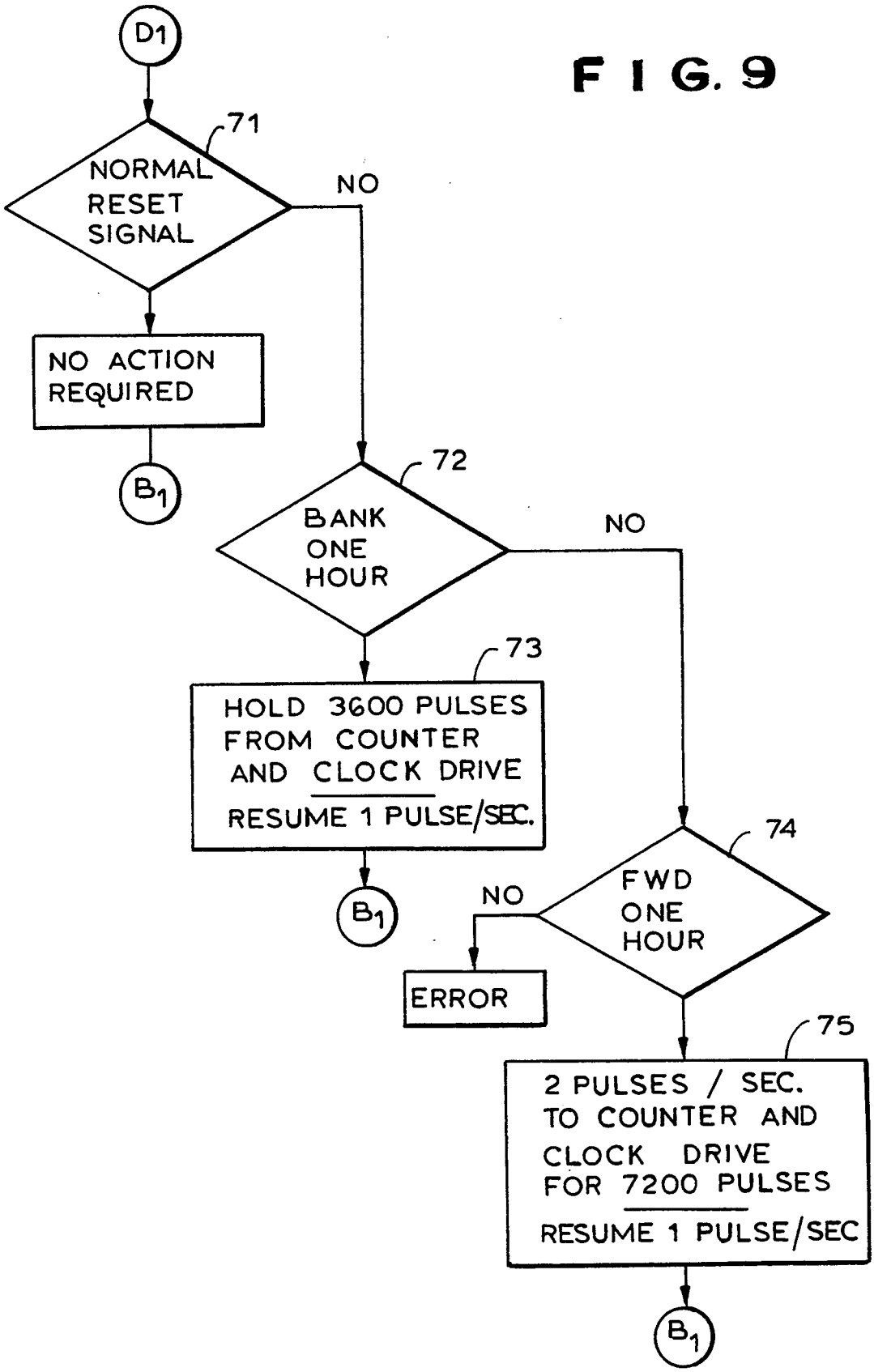

In the portion of the logic flow diagram indicated in FIG. 9, the character of the reset signal is tested to determine whether it indicates the start or end of daylight saving time. Thus, at logic point 71, the signal is tested to see whether it is "normal". If so, no action is required and control is returned to ($B_1$) (FIG. 7). If the signal is not normal, it is tested at logic point 72 to determine if the end of daylight saving time is indicated. If the result of this test is affirmative, control passes to logic point 73, which results in the withholding of 3600 pulses from the clock counter 16 and the clock drive 21, after which the pulse stream resumes at the normal rate of one pulse per second, and control returns to point ($B_1$).

If the test at logic point 72 does not indicate the end of daylight saving time, control passes to logic point 74, where the signal is tested to determine if it represents the beginning of daylight saving time. If not, an error condition is indicated. If commencement of daylight saving time is indicated control passes to logic point 75 with the result that pulses are added to the pulse stream to the clock counter and to the clock drive motor 21. Typically, this is accomplished by doubling the rate of the pulse stream, to two pulses per second, for exactly 3600 seconds or one hour. Thereafter, the pulse stream rate is reduced to the normal one pulse per second, and the control of the clock is returned to ($B_1$).

Figure 10:
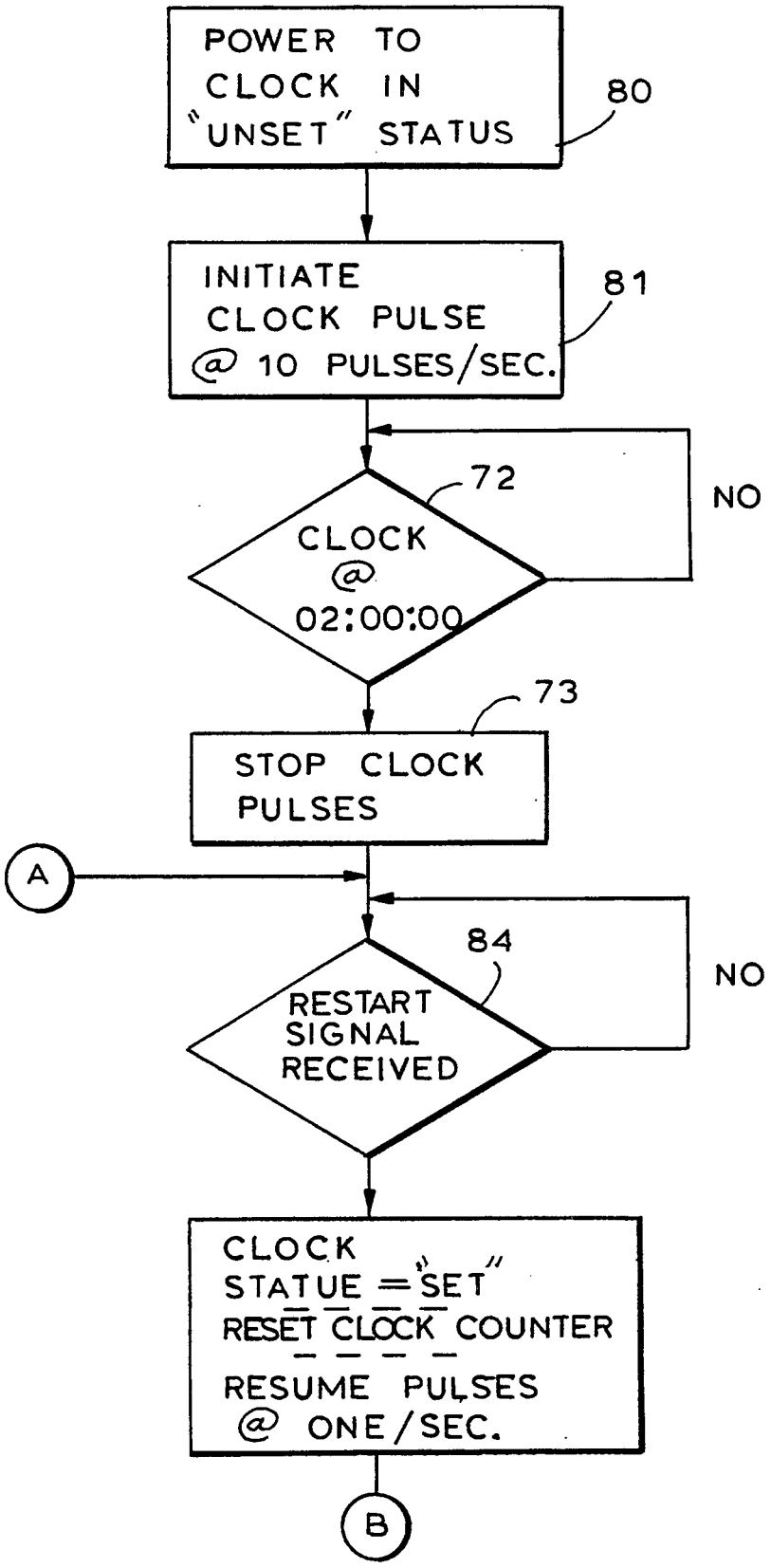
FIG. 10 is a logic diagram for the start-up operation of a clock system according to the invention.

With reference to FIG. 10, there is illustrated a representative logic diagram for control of the clock system of the invention, when the clock is first placed into operation and/or when power is resumed after interruption, such as in the case of replacement of batteries in a battery driven clock, for example. Initially, the logic chip unit 23 includes a status bit which, initially is in an "unset" condition. When power is supplied to the clock with the status bit unset, a pulse stream to the gear drive 21 for the clock is initiated at a rate of ten pulses per second. Thus, starting from any position, the clock hands will reach the 02:00:00 am reset position in a maximum period of 2.4 hours. The initial clock status is determined at logic point 80. If there is power supplied to the clock, clock pulses at the rate of ten per second will be initiated at logic point 81. Control then passes to logic point 82, where the position of the clock is continuously tested for the 02:00:00 am reset position. When that position is reached, control passes to the logic point 83, and the pulse stream to the clock drive 21 is interrupted.

After stoppage of the clock at the 02:00:00 am rest position, control passes to logic point 84, which continually tests for the occurrence of the reset signal received at point (A) from the broadcast source 11. Once the reset signal has been received, control passes to logic point 85, which results in the status bit being "set". In addition, the clock counter is reset to zero and the pulse stream to the clock counter 16 and clock drive 21 is initiated at one pulse per second. Further control passes to point (B) (or ($B_1$), as the case may be).

In the case of the clock system passing ten consecutive days without receipt of a reset signal within the time window provided, the clock system resets the status bit to an "unset" status, which will initiate the sequence of operations of FIG. 10. Of course, if there is a basic failure in the ability of the clock to receive the 02:00:00 am reset signal, the clock will simply remain at logic point 83, with its hands set at the 02:00:00 am reset position, and it will become immediately obvious to the observer that a malfunction exists.

When the clock is operating, even when there is a failure of the rest signal, the clock can never be out of time by more than about ten to twenty seconds, representing the accumulation of a rather high level of daily gain or loss, over a ten day period, until the clock is returned to an "unset" condition. Such a condition may occur, for example, if a clock were located in or relocated to a position in which the broadcast reception was seriously interfered with, or some malfunction occurred in the rf receiver circuitry 13. Significantly, however, the errors permitted by the inability of the clock, for whatever reason, to receive its regular reset signal are significantly limited to a relatively few seconds of accumulated error even under worst case conditions.

Figure 12:
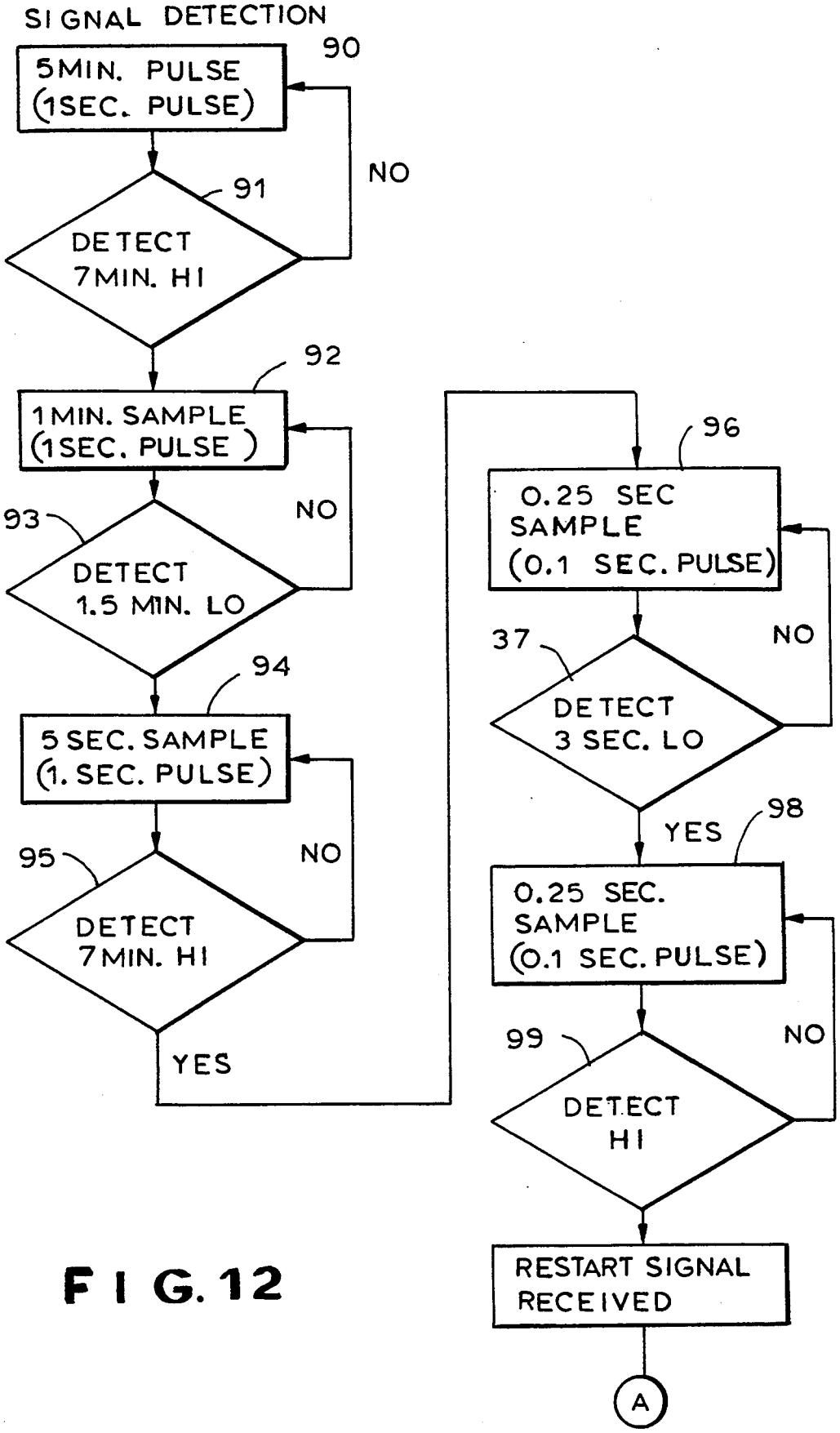
FIG. 12 is a logic flow diagram of the logic steps involved in the detection of a broadcast reset system of the type reflected in FIG. 11.

Although a wide variety of arrangements may be employed for selectively furnishing the reset signal from the broadcast station 11 to the clock 10, one advantageous arrangement is illustrated in FIGS. 11 and 12. To advantage, the broadcast source 11 provides an alerting signal to the clock 10, in advance of the actual reset signal. In the system specifically illustrated in FIGS. 11 and 12, a plurality of such alerting signals are provided, which enables the signal detecting circuity to be utilized to a minimal extent at any time while the clock is in "unset" state, in order to reduce battery drain. Thus, during the initial start-up of a new or "unset" clock, where there may be a period of up to twenty-four hours before the initial reset signal is received, the "unset" clock has no internal system for estimating the expected arrival of the reset signal. Accordingly, in one advantageous embodiment of the invention, the broadcast station 11 is arranged to send a first alert signal constituting a seven minute signal converted by the rf receiver 13 into digital form as a "high" pulse, followed by 1.5 minute signal converted by the rf receiver 13 into digital form as a "low". A second alert signal follows, which is a seven second signal converted by the receiver 13 into a "high" followed by a three second signal converted by the receiver to a "low". Immediately thereafter is a one second signal translatable by the rf receiver into a high, and constituting the actual reset signal. The alert signals should be inaudible to the listener. Advantageously, sub-sonic signals are employed, at frequencies of 1 to 5 $H_2$, for example. The final, one-second reset signal may if desired, be audible.

During an "unset" condition of the clock, the rf receiver system 13 is activated every five minutes (logic point 90, FIG. 12) for a one second period, to test for the seven minute high signal. As soon as the high signal is detected (logic point 90), the receiver is activated every sixty seconds (logic point 92), in order to test for the 1.5 minute low.

When the 1.5 minute low is detected, at logic point 93, control passes to logic point 94 to initiate one second sampling pulses at five second intervals. At logic point 95, the system tests for the presence of the seven second high alert signal, and when that is found control passes to logic point 96 to initiate sampling pulses of one tenth second duration every 0.25 seconds. The last-mentioned sampling pulse tests first for the three second low, at logic point 97, and the eventual high, at logic points 98, 99, signifying the exact moment of arrival of the reset signal. Once the reset signal is detected, at logic point 99, an appropriate signal enters the logic flow at point (A), in FIGS. 5 and 10.

Where battery drain during the "unset" condition of the clock is not a serious concern, the extended "alert" period may be eliminated. For example, the broadcast station 11 may be set to provide an alert signal of 5 seconds duration, which is converted by the rf receiver 13 to digital form as a "high", followed by a 3 second "low", followed by the reset signal itself. In the alternative system, the receiver system is "on" continuously when the clock is an "unset" state. When the 5 second high alert signal is received, the system immediately commences 0.1 second sampling pulses every 0.25 seconds until the reset signal is detected.

In either of the start-up systems contemplated, once the clock is in its "set" condition, the internal time keeping of the clock is utilized to activate the rf receiver 13 only during the brief time window during which the system will accept the reset signal. Accordingly, during normal day-to-day operations, the power consumption by the receiver system is minimal.

In any of the various forms of the invention, a simple, highly economical, yet extremely reliable and accurate means is provided for keeping time, based upon an accurate reference of a master clock located at a remote radio station. The system of the invention enables a daily remotely resettable clock system to be made available on a sufficiently economical basis as to be altogether suitable for routine household utilization.

A particularly advantageous feature of the invention resides in the fact that the twice annual resetting of the clock to accommodate the beginning and end of daylight saving time is accomplished automatically, without the intervention of the user. In a typical household or small business, for example, where there may be numerous clocks employed, the matter of resetting the clocks for advancing or retarding one hour is inconvenient at best, and can be overlooked for at least a short period of time. With the system of the present invention, by simply broadcasting a uniquely different reset signal at the 02:00:00 am reset time on the day of the beginning and the day of the end of daylight saving time, the clocks are automatically adjusted forward or backward exactly one hour, to accommodate this change. In the preferred mode of the invention, the resetting of the clock, and any adjustment forward or backward to accommodate change in daylight saving time, is carried out at 02:00:00 am, so that the adjustments go virtually unnoticed to the user.

Inexpensive, commercially available quartz crystal pulse generating systems, preferably employed in the system of the invention, are reliably accurate within one or two seconds per day. Accordingly, by automatically resetting the system once each day, the accuracy of the clock is maintained on a long term basis within the one or two second daily accuracy of the quartz crystal generator.

Since the invention automatically provides for its precise initial setting during start-up, as well as daily resetting, there is no need to provide for manual manipulation of the clock hands. The mechanical mechanisms otherwise necessary for that purpose are thus eliminated, which represents a significant offset to the cost of the control circuitry utilized by the new system.

The system of the invention is readily adaptable to a wide variety of applications. For example, the timing of day light saving time varies among different countries, and these variations are readily accommodated by minor programming changes in the logic chip controller used in the clock system. Where desired, the clock may also readily incorporate alarm features, using well known technologies. Additionally, although the clock is most ideally suited for battery operation, line power may be utilized where appropriate, being converted to low voltage DC for driving of the clock system.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In a time keeping system of the type comprising a clock having hours, minutes, and seconds time indicating elements, pulse actuated drive means for progressively advancing said time indicating elements in increments of one second or less, and remotely located radio signalling means for periodically synchronizing said clock with respect with said signalling means, the improvement characterized by (a) a crystal oscillator pulse generator for operating said pulse actuated drive means and operative to advance said time indicating elements with an expected level of accuracy within a few seconds per day, (b) a resettable pulse counter actuated by said pulse generator and operative to count pulses of said pulse generator in increments corresponding to increments of advance of said time-indicating elements, (c) said radio signalling means being adapted to generate a clock-reset signal at a precisely predetermined reset time each day, (d) control means operative when the count of said pulse counter is a predetermined number of seconds earlier than said predetermined reset time to increase the rate of pulses delivered to said pulse actuated drive means, temporarily increasing the rate of movement of said time indicating elements, (e) said predetermined number of seconds being at least slightly greater than the expected level of accuracy of said pulse generator, (f) position sensing means operative when said time indicating elements are position precisely at the predetermined reset time for interrupting the flow of pulses to said pulse actuated drive means, whereby said time indicating elements remain fixed at the predetermined reset time, (g) rf receiving means in said clock for selectively receiving said clock reset signal, and (h) reset control means, responsive to receipt of said clock reset signal, for simultaneously resetting said pulse counter to its starting value and for resuming the flow of pulses to said pulse actuated drive means.

2. A time keeping system according to claim 1, further characterized by (a) said pulse actuated drive means comprising a step motor, (b) said time indicating elements comprising rotatable hours, minutes and seconds indicators mounted for coaxial rotation, (c) gear drive means directly connecting said step motor to said time indicating elements, (d) said position sensing means including individual position sensing elements associated with gears mounted for rotating movement for driving said time indicating elements and operative to actuate a control circuit when said time indicating elements are aligned precisely at said predetermined reset time.

3. A time keeping system according to claim 2, further characterized by (a) at least a plurality of said gears being mounted on parallel axes and having portions arranged to be overlapped during at least portions of their rotating movement, (b) each of said plurality of said gears having an opening therein located within said portions arranged to be overlapped (c) a light source directed at said gears parallel to said axes and aligned to be directed at said openings when said gears are in predetermined rotary positions and to be directed through all of the openings when said gears are oriented to position said time indicating elements precisely at said predetermined reset time, and (d) light responsive control means actuated when said light source is directed through all of said openings to interrupt the flow of pulses to said pulse actuated drive means.

4. A time keeping system according to claim 2, further characterized by (a) said position sensing means including switch means associated with said time indicating elements.

5. In a time keeping system of the type comprising a clock having hours, minutes, and seconds time indicating elements, pulse actuated drive means for progressively advancing said time indicating elements in increments of one second or less, and remotely located radio signalling means for periodically synchronizing said clock with respect with said signalling means, the improvement characterized by (a) a crystal oscillator pulse generator for operating said pulse actuated drive means and operative to advance said time indicating elements with an expected level of accuracy within a few seconds per day, (b) a resettable pulse counter actuated by said pulse generator and operative to count pulses of said pulse generator in increments corresponding to increments of advance of said time-indicating elements, (c) said pulse counter including a seconds counter, (d) said radio signalling means being adapted to generate a clock-reset signal at a precisely predetermined reset time each day, (e) rf receiving means in said clock for selectively receiving said clock reset signal, (f) control means becoming initially operative when the count of said pulse counter is a first predetermined number of seconds earlier than said predetermined reset time, and remaining operative until a second predetermined number of seconds after said predetermined reset time, to selectively process said clock reset signal, (g) said first and second predetermined number of seconds being at least slightly greater than the expected level of accuracy of said pulse generator, (h) circuit means for determining the value of said seconds counter upon receipt and processing of said clock reset signal, (i) reset control means, responsive to receipt of said clock reset signal, for temporarily increasing or decreasing the rate of flow of pulses to said pulse counter and to said pulse actuated drive means to add or subtract the number of pulses corresponding to the number of seconds said seconds counter was leading or lagging said clock reset signal.

6. A time keeping system according to claim 5, further characterized by (a) said seconds counter having a range of 0 to 9, (b) said reset control means being operative in response to a seconds counter value in the range of 0 to 4 to interrupt or reduce the rate of pulses to said pulse actuated drive means until the normal flow of such pulses has been reduced by a corresponding number, and (c) said reset control means being further operative in response to a seconds counter value in the range of 6 to 9 to increase the rate of pulses to said pulse actuated drive means until the normal flow of such pulses has been increased by a number in the range of 4 to 1 pulses respectively.

7. An analog clock remotely resettable by radio signal which comprises (a) a pulse generator comprising a crystal controlled oscillator for generating a stream of accurately timed pulses, (b) a plurality of geared-together, changeable time indicating elements for indicating respectively hours, minutes and seconds, (c) a single, pulse actuated motor, driven by said pulse generator, for controllably advancing said time indicating elements in increments of one second or less, (d) pulse counting means for counting said pulses in increments corresponding to the minimum increment of advance of said time indicating elements, (e) an rf receiver for detecting a daily high accuracy clock reset signal from a remote broadcast source, and (f) means for sensing the condition of said pulse counter at the instant of said clock reset signal and thereby determining the exact number of time increments said clock is fast or slow, (g) means operative to effect the addition or substraction of an exact number of pulses from a constant regular stream thereof to advance or retard the position of said time indicating elements an exact number of increments to synchronize exactly with a time reference established by said clock reset signal.

8. A clock according to claim 7, further characterized by said means for adjusting comprising (a) said pulse counter including a plurality of cascaded counter stages, including a seconds stage for counting seconds in the range of 0 to 9, (b) means responsive to the receipt of said clock reset signal for sensing the count value of said seconds stage, and (c) means for adding to or subtracting from the flow of pulses to said pulse actuated means, as a function of said count value, to restore said time indicating elements to synchronism with the time reference established by said clock reset signal.

9. A clock according to claim 7, further characterized by (a) said rf receiver being operative to distinguish among a normal daily reset signal and special reset signals corresponding to the days of the start and end of daylight saving time, (b) first circuit means responsive to the receipt of a reset signal corresponding to the start of daylight saving time to add pulses corresponding to 3600 seconds to said pulse counting means and to said pulse actuated means, and (c) second circuit means responsive to the receipt of a reset signal corresponding to the end of daylight saving time to subtract pulses corresponding to 3600 seconds from the flow of pulses to said pulse counting means and to said pulse actuated means.

10. A clock according to claim 9, further characterized by (a) said second circuit means comprising means to interrupt the flow of pulses to said counting means and to said pulse actuated means for a period of 3600 seconds.

11. A clock remotely resettable by radio signal which comprises (a) a pulse generator comprising a crystal controlled oscillator for generating a stream of accurately timed pulses, (b) changeable time indicating elements for indicating respectively hours, minutes and seconds, (c) a pulse actuated means, driven by said pulse generator, for controllably advancing said time indicating elements in increments of one second or less, (d) pulse counting means for counting said pulses in increments corresponding to the minimum increment of advance of said time indicating elements, (e) an rf receiver for detecting a daily high accuracy clock reset signal from a remote broadcast source, (f) means operative by the addition or substraction of pulses from a constant regular stream thereof for adjusting the position of said time indicating elements to synchronize exactly with a time reference established by said clock reset signal, (g) means responsive to said counter reaching an apparent time a few seconds in advance of said clock reset time for controllably advancing the rate of flow of pulses to said pulse actuated means, whereby said time indicating elements are driven to a position corresponding to said clock reset time a few seconds in advance thereof, (h) means responsive to said time indicating elements being driven to said last mentioned positions to interrupt the flow of pulses to said pulse actuated means, whereby said time indicating elements become fixed, and (i) means responsive to the receipt of a clock reset signal from said remote broadcast source for resetting said pulse counter to zero and resuming the regular flow of pulses to said pulse actuated means.

12. A clock according to claim 11, further characterized by (a) timing circuit means for defining a limited time window within which said clock will process a clock reset signal, if received from said remote broadcast source, (b) means responsive to timing out of said timing circuit means without said clock having received a clock reset signal for restoring to said pulse actuated means a number of pulses corresponding to the pulses occurring while the flow of pulses to said pulse actuated means was interrupted.

13. A clock remotely resettable by radio signal which comprises (a) a pulse generator comprising a crystal controlled oscillator for generating a stream of accurately timed pulses, (b) changeable time indicating elements for indicating respectively hours, minutes and seconds, (c) a pulse actuated means, driven by said pulse generator, for controllably advancing said time indicating elements in increments of one second or less, (d) pulse counting means for counting said pulses in increments corresponding to the minimum increment of advance of said time indicating elements, (e) an rf receiver for detecting a daily high accuracy clock reset signal from a remote broadcast source, (f) means operative by the addition or substraction of pulses from a constant regular stream thereof for adjusting the position of said time indicating elements to synchronize exactly with a time reference established by said clock reset signal, (g) said rf receiver being operative to distinguish among a normal daily reset signal and special reset signals corresponding to the days of the start and end of daylight saving time, (h) first circuit means responsive to the receipt of a reset signal corresponding to the start of daylight saving time to add pulses corresponding to 3600 seconds to said pulse counting means and to said pulse actuated means, and (i) second circuit means responsive to the receipt of a reset signal corresponding to the end of daylight saving time to subtract pulses corresponding to 3600 seconds from the flow of pulses to said pulse counting means and to said pulse actuated means, (j) said first circuit means comprising means to double the rate of pulses to said pulse counting means and to said pulse actuated means for a period of 3600 seconds.

* * * * *